US005254972A

United States Patent [19]

Cordio, Jr.

[11] Patent Number: 5,254,972

[45] Date of Patent: Oct. 19, 1993

[54] WINDOW SEALING KIT

[76] Inventor: Anthony J. Cordio, Jr., 27 Belmont Cir., Danbury, Conn. 06810

[21] Appl. No.: 933,830

[22] Filed: Aug. 24, 1992

[51] Int. Cl.[5] ..... G08B 13/08; E05D 15/06; H01H 3/16

[52] U.S. Cl. ..... 340/545; 49/404; 200/61.81

[58] Field of Search ..... 340/545, 550, 665; 200/61.62, 61.81, 61.82; 49/404, 493, 498, 13-14

[56] References Cited

U.S. PATENT DOCUMENTS 4,464,864 8/1984 Yackiw ..... 49/404
4,722,151 2/1988 Westwell ..... 49/14 X

FOREIGN PATENT DOCUMENTS 9113230 9/1991 World Int. Prop. O. ..... 49/404

*Primary Examiner*—Thomas Mullen
*Attorney, Agent, or Firm*—Leon Gilden

[57] ABSTRACT

A window sealing kit includes plural pairs of upper and lower sealing members mounted between respective upper and lower windows relative to the window frames to effect sealing and maintain positioning of the windows relative to the frames.

4 Claims, 4 Drawing Sheets

WINDOW SEALING KIT

BACKGROUND OF THE INVENTION

1. Field of the Invention

The field of invention relates to window sealing structure, and more particularly pertains to a new and improved window sealing kit wherein the same is arranged to enhance sealing as well as maintaining positioning of a window relative to a frame.

2. Description of the Prior Art

Windows upon aging, particularly in homes of older construction, have their frames subject to shrinkage as well as typical erosion and wear relative to mating surfaces of the windows and the frames.

The instant invention attempts to overcome deficiencies of the prior art by providing for a sealing kit arranged to accommodate interface between a window frame and slidably mounted windows to enhance sealing and assist in positioning of the window relative to the framework.

SUMMARY OF THE INVENTION

In view of the foregoing disadvantages inherent in the known types of window structure now present in the prior art, the present invention provides a window sealing kit wherein the same employs sealing members arranged between windows and their frames to enhance sealing and alignment of the windows relative to the frame and to further include relief cutouts relative to portions of the sealing members to accommodate window sash ropes mounted to the window frames. As such, the general purpose of the present invention, which will be described subsequently in greater detail, is to provide a new and improved window sealing kit which has all the advantages of the prior art window construction and none of the disadvantages.

To attain this, the present invention provides a window sealing kit including plural pairs of upper and lower sealing members mounted between respective upper and lower windows relative to the window frames to effect sealing and maintain positioning of the windows relative to the frame.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved window sealing kit which has all the advantages of the prior art window construction and none of the disadvantages.

It is another object of the present invention to provide a new and improved window sealing kit which may be easily and efficiently manufactured and marketed.

It is a further object of the present invention to provide a new and improved window sealing kit which is of a durable and reliable construction.

An even further object of the present invention is to provide a new and improved window sealing kit which is susceptible of a low cost of manufacture with regard to both materials and labor, and which accordingly is then susceptible of low prices of sale to the consuming public, thereby making such window sealing kits economically available to the buying public.

Still yet another object of the present invention is to provide a new and improved window sealing kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
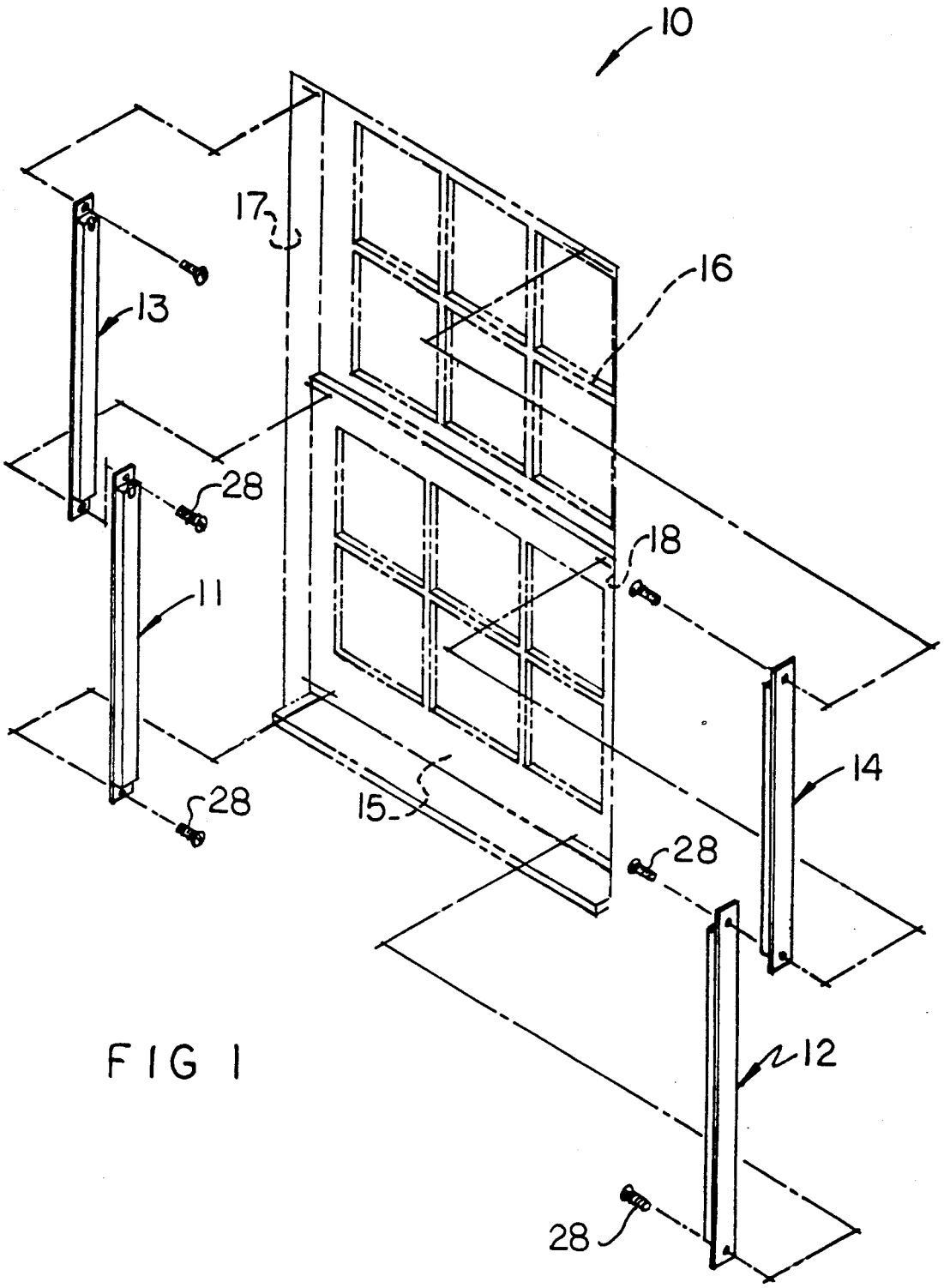
FIG. 1 is an isometric illustration of the instant invention.
Figure 2:
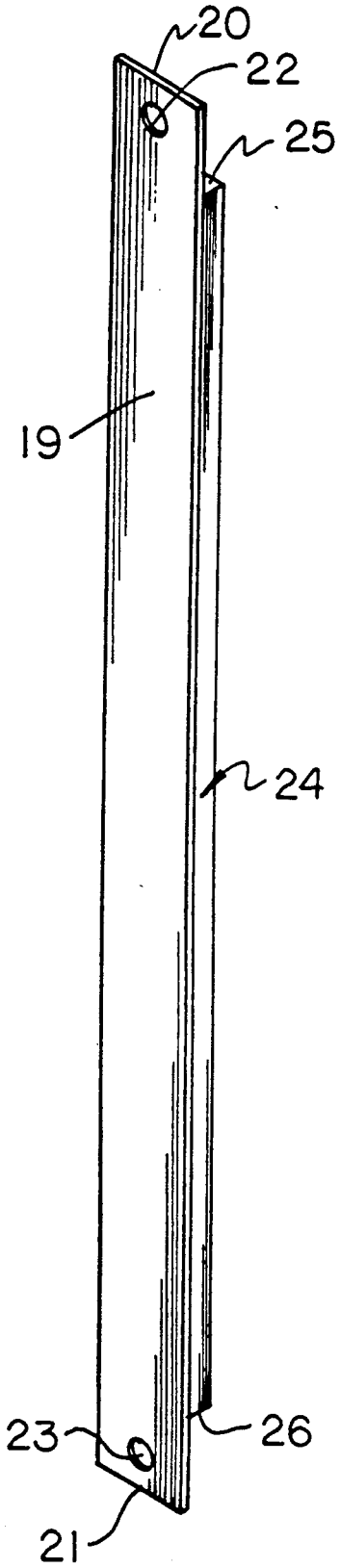
FIG. 2 is an isometric illustration of an individual sealing member utilized by the invention.
Figure 3:
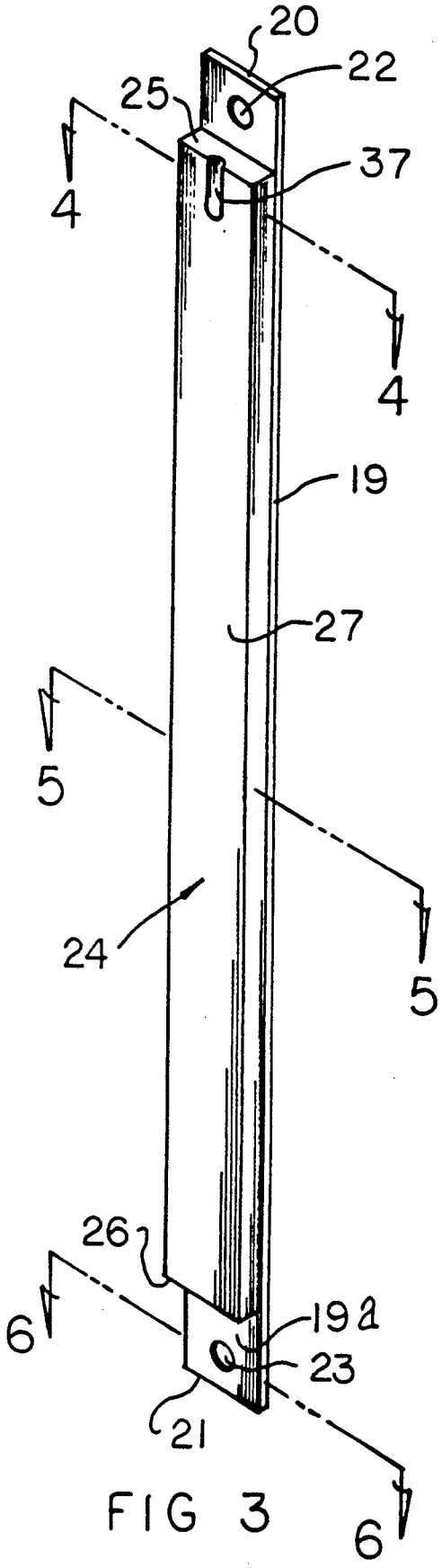
FIG. 3 is a frontal isometric illustration of the window sealing member.
Figure 4:
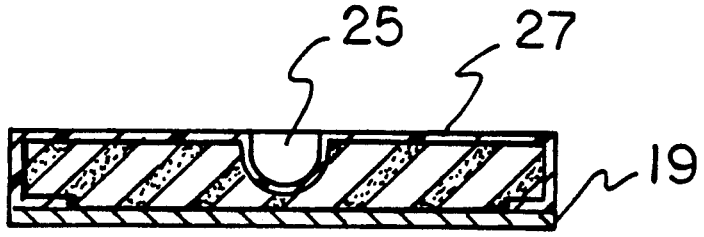
FIG. 4 is an orthographic view, taken along the lines 4—4 of FIG. 3 in the direction indicated by the arrows.
Figure 5:
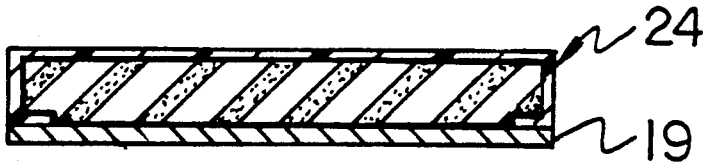
FIG. 5 is an orthographic view, taken along the lines 5—5 of FIG. 3 in the direction indicated by the arrows.
Figure 6:
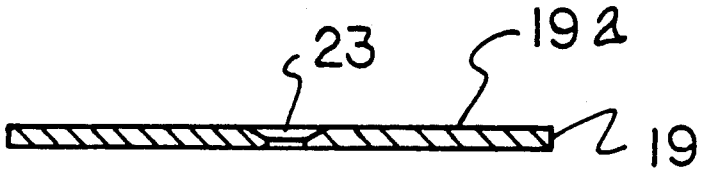
FIG. 6 is an orthographic view, taken along the lines 6—6 of FIG. 3 in the direction indicated by the arrows.

With reference now to the drawings, and in particular to FIGS. 1 to 8 thereof, a new and improved window sealing kit embodying the principles and concepts of the present invention and generally designated by the reference numeral 10 will be described.

More specifically, the window sealing kit 10 of the instant invention essentially comprises respective first and second lower sealing members 11 and 12 mounted between a lower window 15 and between the lower window 15 and respective first and second window frames 17 and 18, wherein first and second upper sealing members 13 and 14 are positioned between an upper window 16 and between the first and second window frames 17 and 18, in a manner as indicated in FIG. 1. The sealing members 11–14 are mounted by utilization of fasteners 28. To this end, each sealing member (see FIGS. 2–6) includes a flexible support strip 19 having a first end and a second end and a support strip front wall of coplanar configuration extending between the first and second ends 20 and 21. First and second respective apertures 22 and 23 are directed through the strip 19 adjacent the respective first and second ends 20 and 21, wherein each aperture is arranged to receive the aforenoted fastener 28, in a manner as indicated in FIG. 1.

A resilient compressible sealing strip 24 is provided having a sealing strip first end and a sealing strip second end positioned between the first and second apertures 22 and 23, with the strip first end 25 positioned adjacent the first aperture 22 and the sealing strip second end 26 positioned adjacent the second aperture 23. A sealing strip front wall 27 oriented substantially parallel to the support strip front wall 19*a* is arranged to provide for an engaging surface to provide sealing relationship between the associated windows and the window framework members, as indicated in FIG. 1.

The slot 37 is directed into each sealing strip 24 extending from the sealing strip front wall through the sealing strip first end 25. The slots 37 are oriented to accommodate conventional sash ropes (not shown) that are employed to position windows that employ sash ropes and sash weights, wherein such windows are of conventional construction, and the slots accommodate the sash ropes to permit the sealing members 11, and more particularly, the sealing strips 24 to extend to a greater length along sides of the associated windows 15 and 16.

Figures 7, 8:
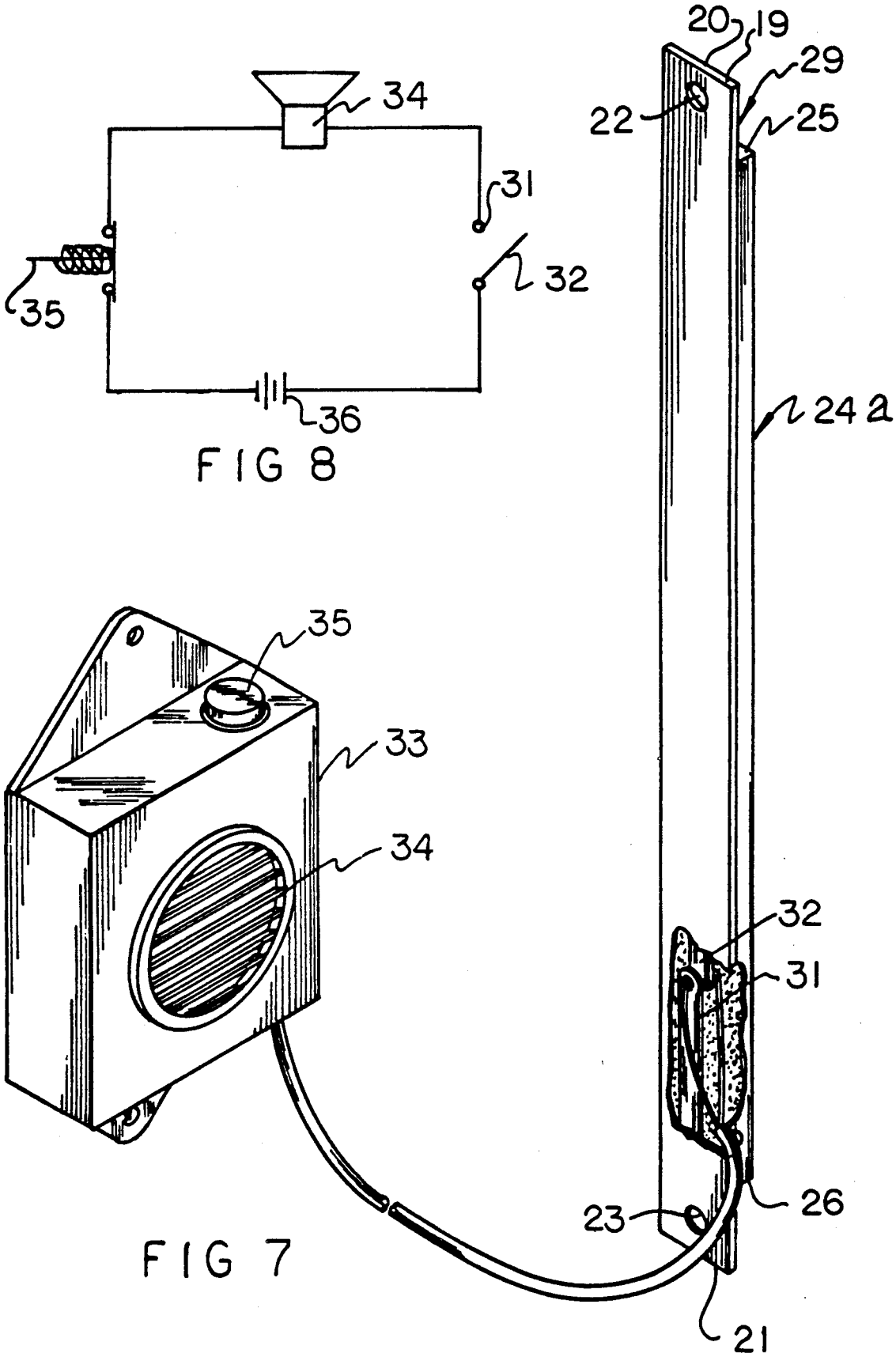
FIG. 7 is an isometric illustration of a modified sealing member utilized by the invention.
FIG. 8 is a diagrammatic electrical schematic illustration of the organization as utilized in FIG. 7.

The FIGS. 7 and 8 indicate the use of a modified sealing member 29 having a modified sealing strip 24*a* that includes in addition to the shape retentive body configuration of the sealing strip 24 to maintain its generally parallelepiped configuration, a first electrical contact arm 31 fixed within the modified sealing strip 24 positioned in confronting relationship relative to a second electrical contact arm 32 that is arranged in a biased and spaced relationship relative to the first contact arm 31. Upon a window such as the window 15 being directed along the modified sealing strip 24*a*, compression of the sealing strip 24 is thereby effected and directing the second contact arm 32 into the first contact arm 31 to complete circuitry relative to a battery 36 and an audio speaker 35 within an associated alarm housing 33. In this manner, proper indication relative to the audio alarm or signal structure 34 notes the proper and complete displacement of the windows 15 and 16 when directed the full extent of the associated sealing strip 24*a*, as the first and second electrical contact arms 31 and 32 are positioned in adjacency relative to the sealing strip second end 26. A reset switch 35 is provided to provide for selective deactivation of the alarm or indicator structure, as indicated, with the reset switch 35 directed through the alarm housing 33.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window sealing kit arranged for sealing a lower window and an upper window within a first side frame and a second side frame, wherein the kit comprises, a first lower sealing member and a second lower sealing member arranged for positioning on opposed sides of the lower window between the first frame and the second frame, and a first upper sealing member and a second upper sealing member arranged for positioning on opposed sides of the upper window between the upper window and the respective first side frame and the second side frame, and each sealing member includes a flexible support strip, the flexible support strip having a support strip first end and a support strip second end, and a first aperture directed through the support strip adjacent the support strip first end, and a second aperture directed through the support strip adjacent the support strip second end, and a first fastener and a second fastener directed through the respective first aperture and the second aperture, and a resilient compressible sealing strip mounted to the support strip between the support strip first aperture and the support strip second aperture, wherein the sealing strip is of a shape retentive material having a sealing strip first end and a sealing strip second end, and a sealing strip front wall arranged coextensively between the sealing strip first end and the sealing strip second end, the support strip having a support strip front wall, wherein the sealing strip front wall is arranged parallel to the support strip front wall.

2. A kit as set forth in claim 1 wherein a slot is directed through the sealing strip front wall and through the sealing strip first end.

3. A kit as set forth in claim 2 wherein at least one of said sealing members includes a first electrical contact arm fixed within the sealing strip, and a second electrical contact arm arranged in a spaced, confronting relationship relative to the first arm and biased away therefrom, whereupon compression of the sealing strip by one of said lower window or upper window effects electrical communication between the first arm and the second arm, wherein the first arm and the second arm are in electrical communication with a battery and a speaker, the battery and the speaker are mounted within an alarm housing, and the alarm housing is arranged in a spaced relationship relative to at least one sealing member.

4. A kit as set forth in claim 3 wherein the alarm housing includes a reset switch to effect electrical disconnection between the battery and the speaker.

* * * * *